United States Patent [19]

Palmer et al.

[11] Patent Number: 4,492,188

[45] Date of Patent: Jan. 8, 1985

[54] INTERNAL COMBUSTION ENGINE

[76] Inventors: Dennis C. Palmer, P.O. Box 8009, Fountain Valley, Calif. 92708; Edward B. Palmer, 3520 E. Janice St., Long Beach, Calif. 90805

[21] Appl. No.: 459,765

[22] Filed: Jan. 21, 1983

[51] Int. Cl.[3] ..... F02B 25/28

[52] U.S. Cl. ..... 123/58 R; 123/58 A; 123/63; 123/193 CH; 123/196 R

[58] Field of Search ..... 123/63, 58 R, 58 A, 123/58 AA, 58 AB, 58 AM, 193 HC, 62, 196 R

[56] References Cited

U.S. PATENT DOCUMENTS

| | | | |
|---|---|---|---|
| 1,675,629 | 7/1928 | Andrews | 123/58 AB |
| 1,796,453 | 3/1931 | Goehler | 123/52 A |
| 2,237,621 | 4/1941 | Herrmann | 123/58 AB |
| 2,237,989 | 4/1941 | Herrmann | 123/58 AB |
| 2,243,817 | 5/1941 | Herrmann | 123/58 AB |
| 2,243,818 | 5/1941 | Herrmann | 123/41.31 |
| 2,243,819 | 5/1941 | Herrmann | 123/196 R |
| 2,243,820 | 5/1941 | Herrmann | 123/58 AB |
| 2,567,576 | 9/1951 | Palumbo | 123/58 AB |
| 2,983,264 | 5/1961 | Herrmann | 123/58 BB |
| 3,016,110 | 1/1962 | Herrmann | 184/6.17 |

*Primary Examiner*—Craig R. Feinberg
*Assistant Examiner*—David A. Okonsky
*Attorney, Agent, or Firm*—William C. Babcock

[57] ABSTRACT

An internal combustion engine in which first and second elongate blocks of identical structure are axially aligned and held in longitudinally spaced relationship by a generally cylindrical connector. The first and second blocks cooperate to define a number of axially aligned cylinders, each of which has a double ended piston slidably mounted therein, and each of which piston supports a pair of cam engaging members. A drive shaft is rotatably supported in the first and second blocks, which drive shaft supports a force receiving cam that is engaged by the pairs of members on the pistons, with the cam situated within the confines of the connector. First and second circumferentially extending fuel intake chambers are defined in the first and second blocks, with each being fed fuel from opposite sides thereof, and force being sequentially applied to the pistons by exploding a fuel charge in first one end of each cylinder and then the opposite end thereof, and the pistons as they move in response to the explosion of the fuel charges imparting rotary motion of the cam to rotate the drive shaft. Coolant is discharged into opposite sides of the coolant chamber to more effectively cool the engine. Accessories are preferably disposed in a housing that is interchangeable with a forwardly disposed bullet nose shaped valve cover through which the drive shaft extends to a power take off. Lubrication is pressure fed and is through the drive shaft that is hollow. Should it be desired the engine may be used with but a single block.

1 Claim, 10 Drawing Figures

INTERNAL COMBUSTION ENGINE

SUMMARY OF THE INVENTION

The internal combustion engine that is the subject of this application is an improvement on the engine disclosed in a series of patents issued to Karl L. Herrmann that are U.S. Pat. Nos. 2,237,621; 2,243,817; 2,237,989; 2,243,819; 2,243,820; 2,243,818; 2,983,264 and 3,016,110.

The present engine has the operational advantages that is combines high power, torque and thrust while providing extremely small frontal area, low weight and a minimum of moving parts. The invention utilizes no crank shaft, crank case, main bearings, caps, liners or bolts. Furtheremore, the engine has no connecting rods, no separate valve cam shaft, bearings and timing gears therfor and no push rods. The engine requires no vibration dampeners, counter weights or fly wheel. In the internal combustion engine of the present invention a straight shaft and main cam replace the conventional crank shaft. Valves in the invention are operated by disc cams mounted on the drive shaft.

A major object of the present invention is to provide an internal combustion engine of simplified structure and improved performance, and one that in the preferred form utilizes two elongate blocks of identical structure that are axially aligned and held in longitudinally spaced relationship by a cylindrical connector that serves as a housing for the main cam that is mounted on an axially disposed drive shaft and actuated by a number of double ended pistons slidably mounted in a number of circumferentially spaced, parallel cylinders defined by the two engine blocks.

Another object of the invention is to supply an internal combustion engine that eliminates the necessity of machining the engine blocks for cam clearance, and has an improved coolant system in which coolant is concurrently discharged thereinto from opposite sides thereof.

Yet another object of the invention is to provide an engine having improved force transmitting cam followers, and with the engine accessories being disposed in housing that is interchangeable with a bullet nose shaped valve cover through which the drive shaft extends, and the drive shaft capable of having power take offs on both ends thereof.

Yet another object of the invention is to supply an internal combustion engine that has an improved lubrication system, and one that is adaptable for single ended cam design.

These and other objects and advantages of the invention will become apparent from the following description of a preferred and alternate forms thereof.

DESCRIPTION OF THE PREFERRED EMBODIMENT

Figure 1:
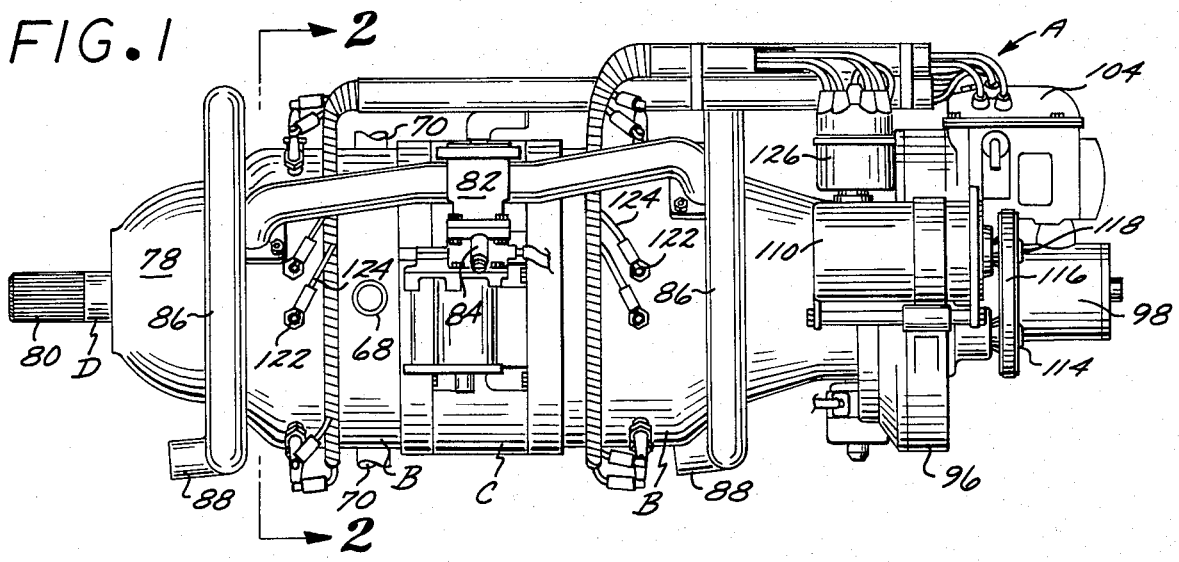
FIG. 1 is a side elevational view of a preferred form of the internal combustion engine.
Figure 2:
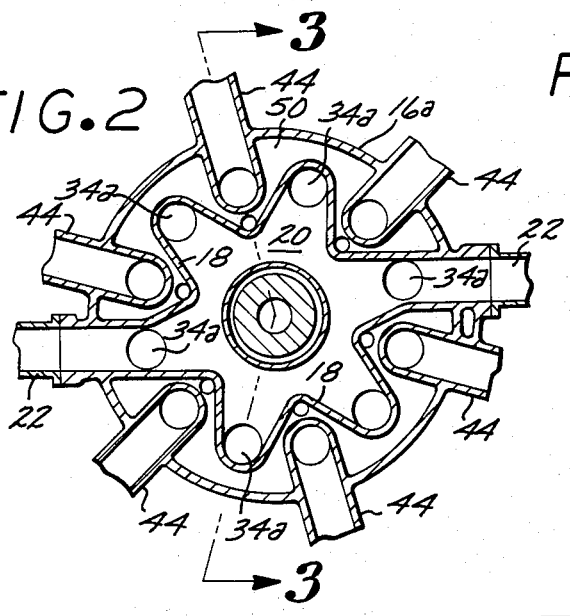
FIG. 2 is a transverse cross sectional view of the engine taken on the line 2—2 of FIG. 1.
Figure 3:
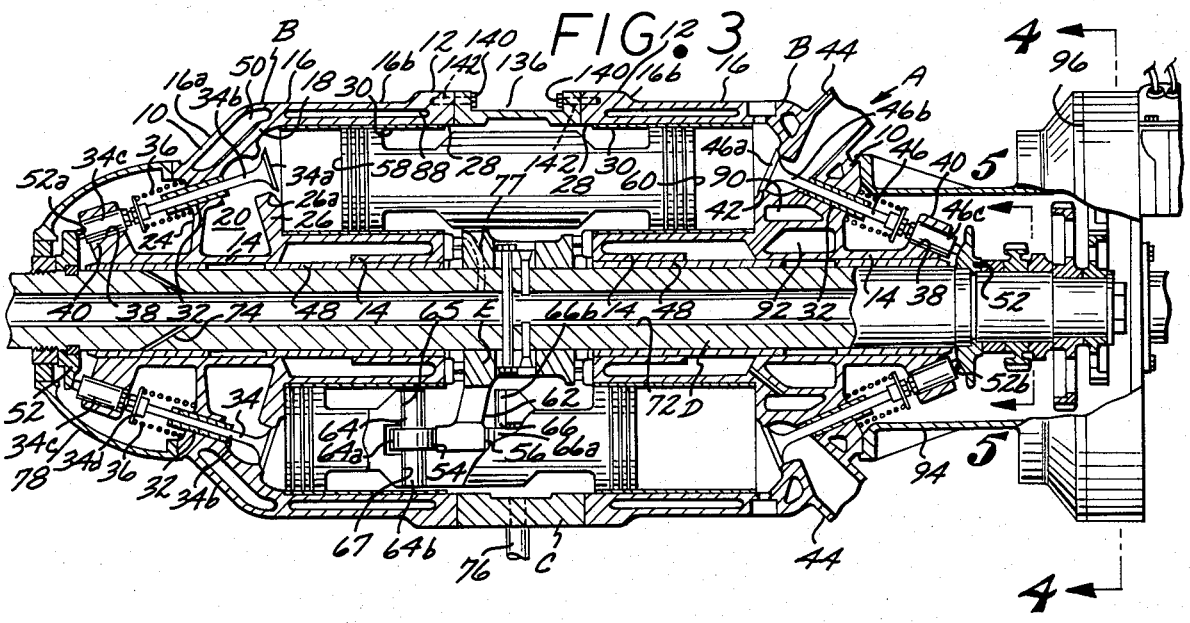
FIG. 3 is a longitudinal cross sectional view of the engine taken on the line 3—3 of FIG. 2.

The internal combustion engine A of the present invention as may best be seen in FIGS. 1 to 3 includes two identical elongate engine blocks B that are axially aligned but oppositely disposed, and so maintained by a generally cylindrical tubular spacer C. Each block B includes a first end portion 10 and a second end portion 12 that is adjacently disposed to the spacer C.

Each block B as best seen in FIG. 3 includes an inner longitudinally extending tubular wall 14 and an outer generally cylindrical wall 16. The outer wall 16 includes a first section **16*a* that tapers outwardly and merges into a second section 16*b*. Each block B includes a generally star shaped partition 18 that extends longitudinally and in conjunction with a first wall 24 and second wall 26 defines a confined space 20. The confined space 20 is in communication with two oppositely disposed fuel inlet conduits 22 as shown in FIG. 2**, with the confined space serving as a fuel manifold.

The second wall 26 has a number of circumferentially spaced valve seats **26*a* formed therein, with each of the valve seats being in communication with one of a number of circumferentially spaced elongate cylinders 28 that extend longitudinally in the block. Each cylinder 28 is provided with a liner 30**.

The first wall 24 supports a number of circumferentially spaced, longitudinally extending, angularly disposed tubular bushings 32 in which the stems **34*b* of fuel inlet valves 34 are slidably supported. The fuel inlet valves 34 include heads 34*a* and tappets 34*c*. Each of the stems 34*b* has a projection 34*d* thereon that is engaged by one end of a compressed helical spring 36 that encircles the stem and has one end in abutting contact with first wall 24. The springs 36 at all times tend to maintain the fuel inlet valve heads in sealing engagement with valve seats 36*a*. The tappets 34*c* are slidably supported in bores 38 formed in a ring 40 that extends outwardly from the inner wall 14**.

The structure above described is common to the block B shown on the left in FIG. 3 as well as the block B on the right, although not shown in the last mentioned block. Each of the cylinders 28 in both the blocks B shown in FIG. 3 is in communication with an exhaust valve seat 42 that has an exhaust conduit 44 extending outwardly therefrom as best seen in FIG. 2.

A number of exhaust valves 46 are provided, each of which includes a head **46*a*, stem 46*b*, and tappet 46*c*. The tappets 46*c* are slidably supported in bores 38 formed in the rings 40. Each of the blocks B has an elongate tubular bearing 48 supported within the inner cylindrical wall 14 thereof as best seen in FIG. 3**.

The tubular bearings 48 serve to rotatably support a drive shaft D. The drive shaft D has two cam discs 52 mounted in longitudinal spacing thereon as shown in FIG. 3, with each disc having an outer cam surface **52*a* and inner cam surface 52*b*. The tappets 34*c* of the fuel inlet valves 34 are in slidable engagement with the outer cam surfaces 52*a*. The tappets 46*c*** of the exhaust valves 46 are in slidable engagement with the inner cam surfaces 52*b*.

The drive shaft D has an intermediately positioned force receiving cam E mounted thereon, which cam has a transverse T shaped cross section. The cam has continuous oppositely disposed first and second force receiving edge surfaces 54 and 56 defined thereon as best seen in FIG. 3. The cam E is removably secured to drive shaft D by bolts or other fastening means. The cam E rotates between conventional thrust bearings.

Each of the cylinders 28 has a piston F slidably mounted therein. Each piston F has first and second end surfaces 58 and 60, and an inner longitudinally extending cut out portion 62 situated therebetween into which the force receiving cam E extends. Each of the pistons F has a pair of force imparting first and second cam followers 64 and 66 mounted in the cut out portion 62 thereof, with the cam followers being at all times in abutting contact with the first and second force receiving cam surfaces 54 and 56.

In FIGS. 2 and 3 it will be seen that the partition 18 cooperates with the outer wall section 16*a* to define a confined space 50 into which a liquid coolant is discharged through two oppositely disposed conduits 68 to flow from a pair of oppositely positioned conduits 70 as shown in FIG. 1.

The drive shaft D has a bore 72 extending longitudinally therein that is sealed at the ends by means (not shown). The bore 72 receives liquid lubricant under a pressure of approximately 15 pound pressure per square inch, with the lubricant flowing through transverse passages 74 to lubricate the interiors of the bearings 48 and then flow downwardly to the bottom of the engine where it discharges through an outlet 76 to be returned under pressure to the bore 72. Lubricant under pressure also flows from the bore 76 through bores 77 in the rotor E to lubricate the pistons F and cam followers 64 by discharging as jets thereon, and the lubricant so discharged thereafter flowing by gravity to the outlet 76.

In FIG. 3 it will be seen that the left hand block B illustrated therein has a bullet nose shaped cover 78 projecting outwardly therefrom to conceal the valve mechanism, and through which cover the drive shaft D extends to terminate in a serrated power take off 80. A first carburetor 82 is shown in FIG. 1 to which fuel is discharged through a line 84, with the fuel mixing with air and flowing through the two conduits 22 to the two confined spaces 20, one of which is illustrated in FIG. 2. A second carburetor (not shown) is located on the opposite side of the engine A, and by conduits (not shown) supplies an air fuel mixture to the opposite sides of the confined spaces 20 to assure that the engine when operating at maximum speed will not suffer from fuel starvation. The exhaust conduits 44 as shown in FIGS. 1 and 2 are connected to two circular manifolds 86 that have exhaust pipes 88 extending therefrom to communicate with the ambient atmosphere.

A closed liquid coolant system is provided that includes a power driven pump (not shown) that recirculates the liquid coolant in succession through the confined space 50, and additional transverse circumferentially extending confined spaces 88, 90 and 92 that are identified in FIG. 3, and provided in both of the engine blocks B.

Figure 7:
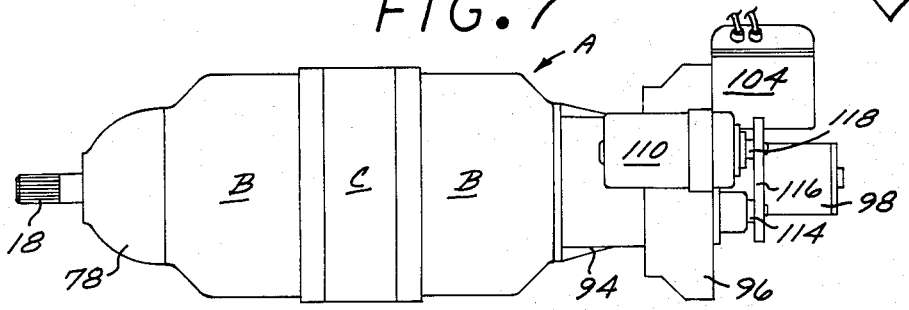
FIG. 7 is a side elevational view of the engine.

The engine block B as indicated to the right as viewed in FIG. 3 has a cylindrical shell 94 extending outwardly therefrom, which shell supports a housing 96. The housing 96 supports a starter 98 that may be electrically energized to move a pinion gear 100 into removable engagement with a gear 102 secured to drive shaft D as shown in FIGS. 1, 4 and 7.

Figure 4:
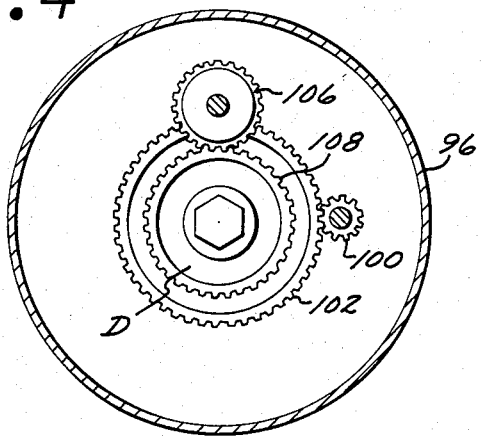
FIG. 4 is a transverse cross sectional view of the engine taken on the line 4—4 of FIG. 3.

A pair of magnetos 104 are provided and secured to the housing 96, each of which includes a gear (not shown) that is driven by a gear 106 shown in FIG. 4 that in turn is driven by a gear 108 secured to the drive shaft D. An alternator 110 is supported on a bracket 112 that is secured to the housing 96, with the alternator including a driven pulley 114 that is engaged by a belt 116 that extends to a pully 118 that forms a part of a power take off 120 that is driven by shaft D.

Figure 5:
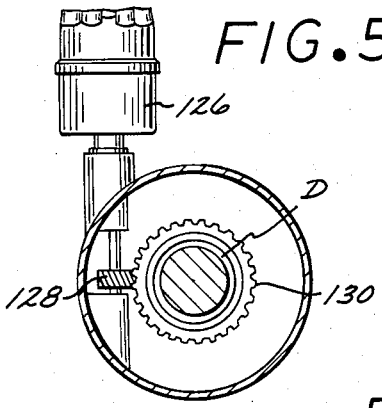
FIG. 5 is an end elevational view of the distrubutor drive.

Each of the engine blocks B is provided with a set of circumferentially spaced spark plugs 122 that are in communication with the cylinders 28 therein. The spark plugs 122 have insulated wires 124 extending therefrom to a distributor 126 that includes a drive gear 128 that is in toothed engagement with a gear 130 secured to drive shaft D as shown in FIG. 5.

The cam followers 64 and 66 in the form shown in FIG. 3 each include rollers 64*a* and 66*a* that have trunnions 64*b* and 66*b* extending outwardly from opposite sides thereof. The rollers 64*a* and 66*a* are at all times in rolling abutting contact with the first and second edge surfaces 54 and 56 of the cam E. The first and second edge surfaces 54 and 56 define an endless sinusoidal curve that causes the cam E to rotate when the pistons F reciprocate due to the sequential firing of air-fuel charges in the ends thereof. The rollers 64*a*, 66*a* are disposed at opposite ends of the cutouts 62 of the pistons F, with the trunnions rotatably engaging grooves and bores 65 and 67 formed in the pistons.

Figure 6:
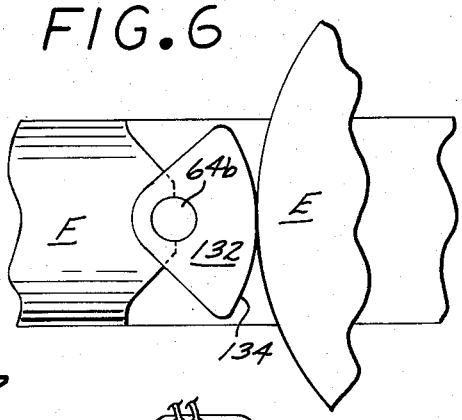
FIG. 6 is a top plan view of a preferred form of cam follower.

An alternate form of cam follower is shown in FIG. 6 in which each set of trunnions 64*b* and 66*b* supports a wedge shaped body 132 that has an arcuate convex surface 134 in sliding contact with the sinusoidal edge surfaces 54 and 56. This form of cam follower has the operational advantage that the force transmitted from the cam follower 132 to the cam E is spread over a greater area by the surface 134 than when a roller of relatively small diameter is used for this purpose.

The operation of the engine A is simple. The engine as illustrated has six cylinders 28 and pistons F. The pistons F are double headed and operate on four cycles, with the pistons compressing the compressed air fuel mixture being fired alternately at opposite ends of the cylinders 28. The back and forth movement of the pistons F causes the cam E to rotate together with the drive shaft D to which it is secured. The engine A during operation has pure harmonic motion and is so perfectly balanced that there is practically no vibration, and as a result there is no need for counter weights, vibration dampeners or a fly wheel.

The connector C has a number of circumferentially spaced longitudinal recesses 136 therein from which bores 138 extend towards the engine blocks B. Bolts 140 extend through the bores 138 to engage tapped recesses 142 formed in the engine blocks B and serve to hold the engine blocks in axial alignment and in abutting contact with the connector C. By use of the connector C, the necessity of machining the interior of the engine blocks B is eliminated. The engine blocks B as shown in FIG. 3 are cast as an integral unit from a suitable material such as steel or the like, or formed from one of the high strength, high temperature plasters recently developed.

Figure 8:
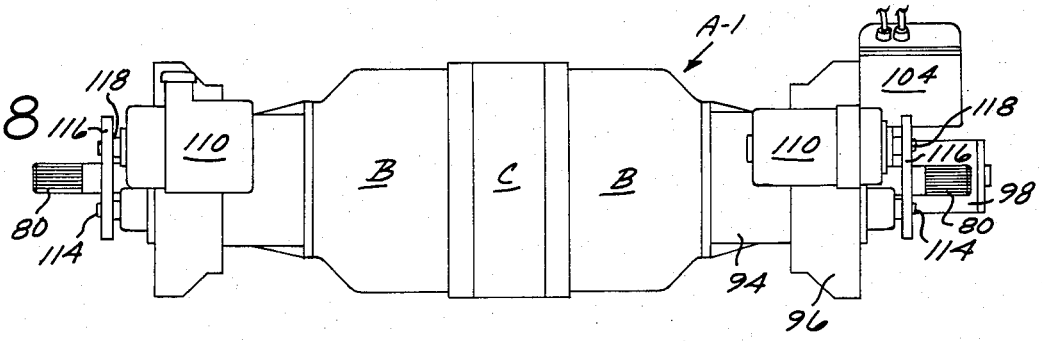
FIG. 8 is a side elevational view of the engine modified to have power take offs on both ends thereof.

A second form A-1 of the engine is shown in FIG. 8 that differs from the first form A only in that it has a power take off 80 on both ends of the drive shaft D.

Figure 9:
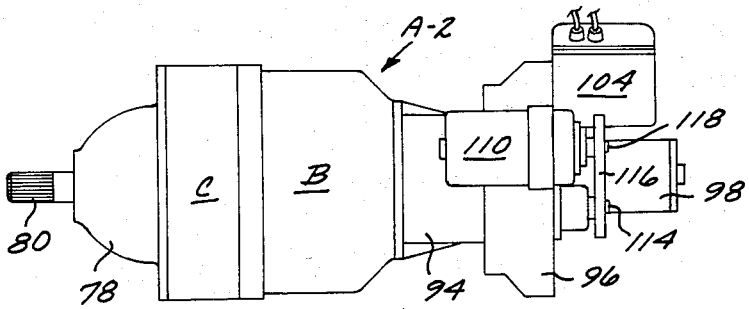
FIG. 9 is a side elevational view of an engine that has been modified to include but a half of the structure shown in FIG. 1.

FIG. 9 illustrates a second alternate form A-2 of the engine that utilizes only the right hand half portion of the engine A and with the pistons having only single ends exposed to the sequential firing of fuel charges.

Figure 10:
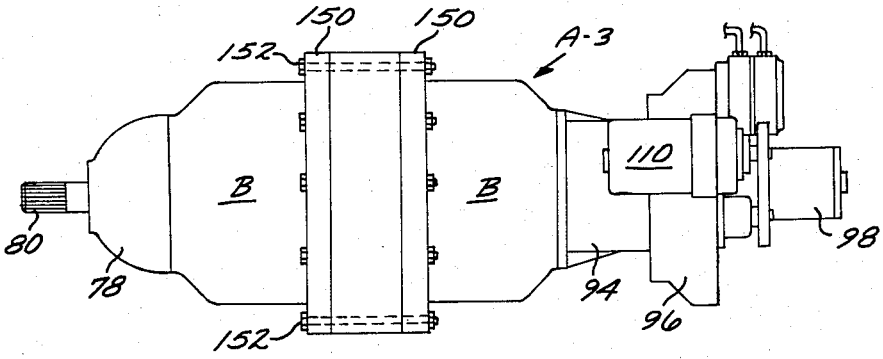
FIG. 10 is a side elevational view of the engine modified to operate as a Diesel.

FIG. 10 shows a third alternate form A-3 of the engine in which the blocks B have flanges 150 extending outwardly from the adjacent ends thereof that are engaged by bolts 152 to removably hold the blocks in abutting contact with the connector C. The third alternate form A-3 is partially adapted for a Diesel engine.

In summary, it will be seen that in the preferred form A , the engine is defined by two elongate engine blocks that are axially aligned and longitudinally spaced from one another by a cylindrical connector shell C that houses the cam E that rotates the drive shaft. This construction is of importance in that it eliminates the necessity of machining out the interiors of the engine blocks B to accommodate the cam E as would be necessary if the engine blocks were in abutting contact. The engine has a small frontal area and offers a lower degree of restistance when moving forwardly through the air.

Another important aspect of the engine is that fuel is concurrently discharged into opposite sides thereof to prevent fuel starvation, and this is also true of the coolant system. The internal portions of the engine are maintained at a substantially constant temperature. Gears and accessories for the engine are concealed within a housing mounted on one end thereof. Lubricant is forced under pressure through the hollow drive shaft to discharge through appropriate openings as a spray onto the valves and pistons, and the lubricant also being directed onto the bearings that rotatably support the drive shaft.

The use and operation of the engine has been described previously in detail and need not be repeated.

What is claimed is:

1. In an internal combustion engine that includes an elongate drive shaft having first and second end portions, a force receiving cam that has first and second oppositely disposed sinusoidal edge surfaces, a plurality of pistons that have first and second ends, a plurality of pair of cam followers mounted on said pistons that are at all times in moving contact with said first and second edge surfaces and that impart rotary motion to said cam and drive shaft when reciprocated relative thereof, an improved block assembly for rotatably supporting said drive shaft, said improved block assembly including:

a. a circular connector shell within which said cam is disposed;

b. forward and rearward identical engine blocks that have adjacent ring shaped surfaces in abutting contact with said connector shell and when so disposed defines a plurality of axially aligned forward and rearward cylinders in which portions of said pistons are at all times slidably disposed;

c. forward and rearward axially aligned tubular bearing in said forward and rearward engine blocks that rotatably support said drive shaft, said drive shaft having an elongate passage and at least one transverse passage in communication therewith;

d. first and second circumferentially extending confined spaces defined in each of said engine blocks, each of said first confined spaces in communication with a plurality of first fuel inlet valve seats that communicate with said cylinders, and each of said first confined space in communication with oppositely disposed fuel inlets through which fuel may be concurrently discharged to assure that said engine will not suffer from fuel starvation, and each of said second confined spaces having oppositely disposed coolant supply inlets through which coolant may be concurrently discharged to cool said engine block and then discharge therefrom, and a plurality of exhaust valve seats in each of said engine blocks in communication with said cylinders;

e. a plurality of spring loaded fuel inlet and exhaust valves in said forward and rearward engine blocks that are movably supported and at all times tend to sealingly engage said fuel inlet and exhaust valve seats;

f. first and second sets of spark plugs in said forward and rearward engine blocks;

g. first and second electrical means including a distributor driven by said drive shaft for supplying high voltage current to said spark plugs to sequentially ignite fuel charges in said cylinders adjacent first ends of said pistons and then fuel charges in said cylinders adjacent second ends of said pistons;

h. first and second cam means mounted on said drive shaft that actuate said fuel inlet and exhaust valves on each of said cylinders to sequentially open and close to admit fuel into and exhaust from said cylinders as said pistons reciprocate relative to said forward and rearward engine blocks;

i. bolt means for removably holding said forward and rearward engine blocks in abutting contact with said connector shell, with said connector shell having a transverse opening therein through which a lubricant may flow by gravity when said engine is in a horizontal position; and j. first means for forcing lubricant under pressure into said elongate and transverse passages to flow therefrom to lubricate said cam, cam followers and said drive shaft in said forward and rearward tubular bearings, and said lubricant discharging through said transverse openings after flowing into an interior confined space defined by said connector shell.

* * * * *